US005868864A

United States Patent [19]

Nishi

[11] Patent Number: 5,868,864

[45] Date of Patent: Feb. 9, 1999

[54] WASHING METHOD USING PURE WATER

[75] Inventor: Kazuyuki Nishi, Sakai, Japan

[73] Assignee: Minolta Co., Ltd., Osaka, Japan

[21] Appl. No.: 756,635

[22] Filed: Nov. 26, 1996

[30] Foreign Application Priority Data

Nov. 27, 1995 [JP] Japan ..... 7-307755

[51] Int. Cl.[6] ..... B08B 3/00

[52] U.S. Cl. ..... 134/30; 134/34; 134/36

[58] Field of Search ..... 134/30, 34, 36

[56] References Cited

U.S. PATENT DOCUMENTS 5,250,117 10/1993 Hirano et al. ..... 134/1

5,334,258 8/1994 Osano et al. ..... 134/42

FOREIGN PATENT DOCUMENTS 6-230325 1/1993 Japan .

*Primary Examiner*—Kriellion S. Morgan

*Attorney, Agent, or Firm*—Burns, Doane, Swecker & Mathis, LLP

[57] ABSTRACT

A method for washing an object, such as an optical element, includes the steps of dipping the object to be washed in a heated liquid and taking the object to washed from the heated liquid used in the dipping process, wherein the resistivity of the heated liquid is 0.5 to 5.0MΩ·cm. In one embodiment, the heated liquid is pure water having a resistivity of 0.5MΩ·cm, and the temperature of the pure water is 40° C., and the pure water has a 0.3 $\mu$m diameter particle count of not greater than 100 particles/ml.

23 Claims, 2 Drawing Sheets

WASHING METHOD USING PURE WATER

BACKGROUND OF THE INVENTION

1. Field of the Invention

The present invention relates to a method for washing components or products, and in particular, to a method for washing optical components.

2. Description of the Related Art

Conventionally, in view of environmental conservation, a variety of methods for washing optical components using pure water have been proposed. For example, a prior art washing method using pure water is disclosed in U.S. Pat. No. 5,334,258 will be described with reference to a flowchart shown in FIG. 1. The process of the washing method shown in FIG. 1 is as follows.

a. Degreasing

This is a process for removing greasy stains (pitch, protecting film, cutting oil, etc.) by dipping the object to be washed in ethylene or a similar substance.

b. Substituting Water System

This is a process for preventing the greasy components of the above process of "a. degreasing" from entering a finish washing process as described below by dipping the object to be washed in an emulsifier.

c. Finish Washing

This is a process for removing a hydrophilic stain by dipping the object to be washed in a detergent.

d. Rinsing

This is a process for removing a residue of the above process of "c. finish washing" by dipping the object to be washed in pure water. The resistivity of the pure water to be used is not smaller than 10.0MΩ·cm.

e. Finish Rinsing

This is a process for removing particulates and ions attached or left on the surface of the object to be washed by dipping the object to be washed in pure water. The resistivity of the pure water to be used is not smaller than 10.0MΩ·cm.

f. Dipping Into Hot Pure Water

This is a process for dipping the object to be washed in a heated hot pure water. This process heats a glass, or the object to be washed up to a temperature at which a surface tension capable of uniformly drying the glass surface can be obtained. The resistivity of the pure water to be used is 10.0MΩ·cm.

g. Taking Out From Hot Pure Water

This is a process for taking the object to be washed out of the pure water used in the above process. At the temperature maintained in the above process of "f. dipping into hot pure water," the object to be washed is taken out at a speed capable of uniformly draining off liquid.

h. Drying

This is a process comprised of a hot air zone and a cooling zone and effects to evaporate a moisture component left on the object to be washed that is taken out of the hot pure water and on the jig that is holding the object to be washed.

However, according to the aforementioned prior art washing method, chemical damage (hidden damage) may occur on the surface of the object to be washed, or in particular, of a glass component. Furthermore, expensive pure water has been used according to this prior art washing method, and this has consequently resulted in a cost increase.

OBJECTS AND SUMMARY

In view of the aforementioned problems, it is an object of the present invention to provide a low-cost washing method capable of sufficiently washing the surface of the object to be washed while leaving little or no hidden damage.

In order to achieve the above object, the washing method of the present invention is a washing method for washing the surface of the object to be washed by dipping the object to be washed in a heated liquid to a specified temperature and thereafter taking the object to be washed out of the liquid, wherein the resistivity of the liquid is 0.5 to 5.0MΩ·cm.

Thus, by setting the resistivity of the liquid to be used to 0.5 to 5.0MΩ·cm in the process of dipping the object to be washed in a liquid heated to a specified temperature and thereafter taking the object to be washed out of the liquid, a good external appearance substantially free of hidden damage can be maintained. When the resistivity of the liquid to be used is less than 0.5MΩ·cm, an ion residue may be left on the surface, for which the reliability of a coat to be provided on the glass surface cannot be secured. When the resistivity of the liquid to be used is not less than 5.0MΩ·cm, a chemical attack (ion exchange, etching, etc.) on the lens surface becomes intense resulting in increased hidden damage. In either case, the intended optical surface cannot be obtained. Furthermore, liquid can be produced more easily than in the prior art, and therefore, the cost for producing the liquid can be reduced.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
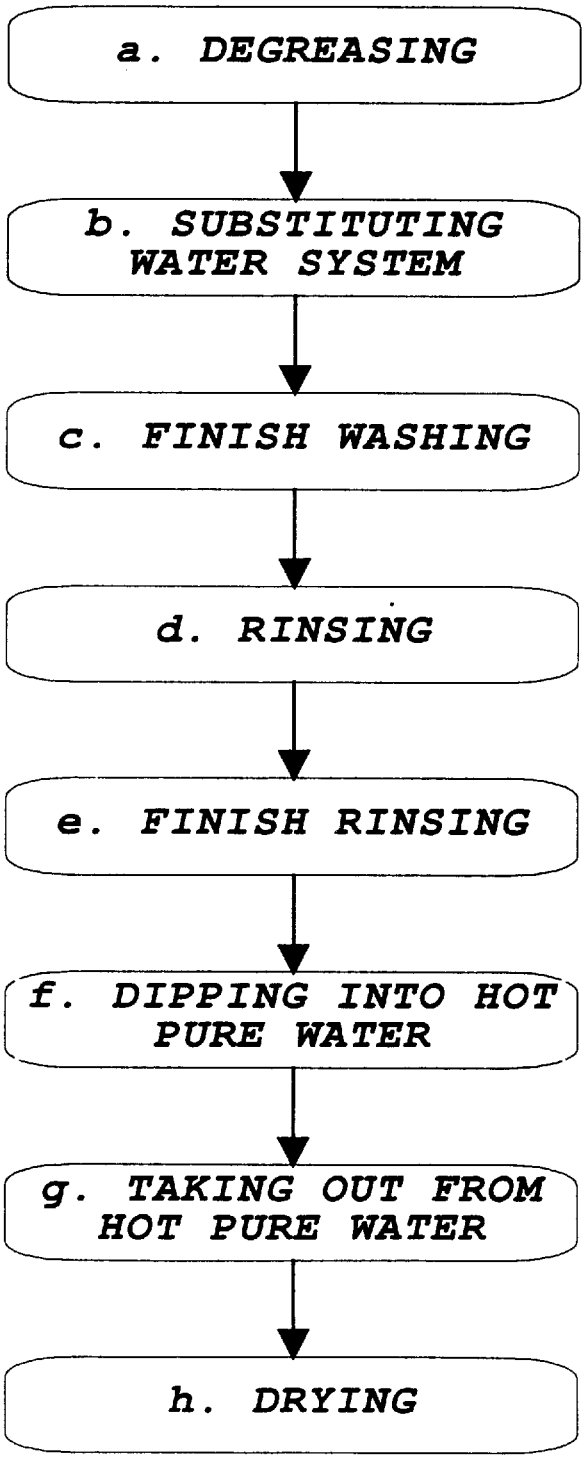
FIG. 1 is a flowchart showing a washing method using pure water.
Figure 2:
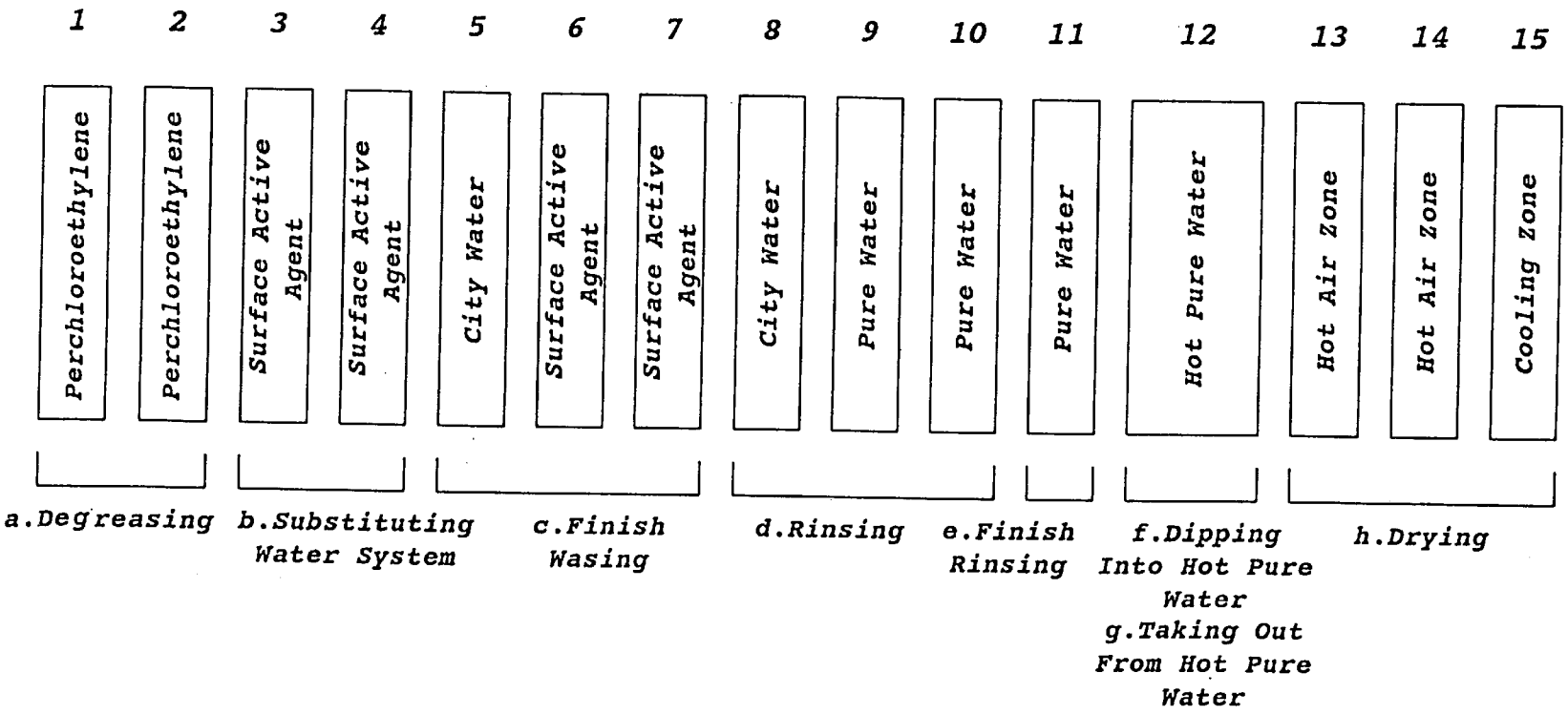
FIG. 2 is a schematic diagram of the treatment baths of the washing method of an embodiment of the present invention.

An embodiment of the washing method according to the present invention will be described with reference to FIGS. 1 and 2. In the present embodiment, names given to the processes are the same as those of the aforementioned prior art washing method, and therefore, the flowchart of FIG. 1 used for the description of the prior art is used for the description of the present embodiment. Further, FIG. 2 is a schematic view of the treatment baths for actual washing.

Processes of the Washing Method

The washing method of the present embodiment is also comprised of eight processes of "a. degreasing" (baths 1 and 2), "b. substituting water system" (baths 3 and 4), "c. finish washing" (baths 5, 6 and 7), "d. rinsing" (baths 8, 9 and 10), "e. finish rinsing" (bath 11), "f. dipping into hot pure water" (bath 12), "g. taking out from hot pure water" (bath 12), and "h. drying" (baths 13, 14 and 15). It is to be noted that the treatment bath numbers given to the processes correspond to the numbers of the treatment baths shown in FIG. 2. The contents of processing to be performed in the processes are as follows.

a. Degreasing

This is a process for removing greasy stains (pitch, protecting film, cutting oil, etc.) by dipping the object to be washed in ethylene or a similar substance (lipophilic agent such as perchloroethylene and tetrachloroethylene). In a preferred present embodiment, this process is executed by successively dipping the object to be washed in perchloroethylene filled in the baths 1 and 2.

b. Substituting Water System

This is a process for preventing the greasy component of the above process of "a. degreasing" from entering a finish washing process as described below by dipping the object to be washed in an emulsifier. In the present embodiment, this process is executed by successively dipping the object to be washed in the emulsifier filled in the baths 3 and 4.

c. Finish Washing

This is a process for removing residues and hydrophilic stains in the process of "a. degreasing" and "b. substituting water system" by dipping the object to be washed in a detergent. In the present embodiment, this process is executed by successively dipping the object to be washed in city water (ordinary tap water) filled in the bath 5 and then in the detergent filled in the baths 6 and 7.

d. Rinsing

This is a process for removing a residue of the above process of "c. finish washing" by dipping the object to be washed in pure water. In the present embodiment, this process is executed by successively dipping the object to be washed in city water filled in the bath 8 and then in a pure water having a temperature of 20° to 30° C. and a resistivity of 0.5MΩ·cm filled in the baths 9 and 10. By setting the resistivity of the pure water as described above, the chemical attack on the surface of the object to be washed can be reduced, so that the possible occurrence of hidden damage can be suppressed.

e. Finish Rinsing

This is a process for removing particulates and ions attached or left on the surface of the object to be washed by dipping the object to be washed in pure water. In the present embodiment, this process is executed by dipping the object to be washed in a pure water that is filled in bath 11 and satisfies the conditions of a water temperature of 20° to 30° C., a resistivity of 0.5 to 5.0MΩ·cm and a particle count of not greater than 100 particles/ml, and the particles have a diameter of less than or equal to 0.3 μm. In addition, there may be an insignificant amount of particles having a diameter that is greater than 0.3 μm. By setting the resistivity of the pure water as described above, the chemical attack on the surface of the object to be washed can be reduced, so that the possible occurrence of a hidden damage can be suppressed.

Furthermore, since the 0.3 μm diameter particle count in the pure water is not greater than 100 particles/ml, the particulates removed from the surface of the object to be washed can be prevented from adhering again to the surface in this process.

In the present embodiment, the particle count in the pure water is low. However, because some ions and particles may exist in the present embodiment, a supersonic wave is preferably not applied in this process. Applying a supersonic wave may increase the contact of particles and ions with the object to be washed, which is unfavorable.

f. Dipping Into Hot Pure Water

This is a process for dipping the object to be washed in a heated hot pure water. In the present case, the glass, or the object to be washed is heated to a temperature at which a surface tension capable of uniformly drying the glass surface can be obtained. In the present embodiment, this process is executed by dipping the object to be washed in a pure water that is filled in the bath 12 and has a temperature of 40° C., a resistivity of 0.5MΩ·cm and a 0.3 μm diameter particle count of not greater than 100 particles/ml.

In this process, the resistivity of the pure water preferably falls within a range of 0.5 to 5.0MΩ·cm. When the resistivity of the pure water is smaller than 0.5MΩ·cm, an ion residue is left on the surface, for which the reliability of a coat to be provided on the glass surface cannot be secured. Conversely, when the resistivity of the pure water to be used is greater than 5.0MΩ·cm, a chemical attack on the lens surface becomes intense resulting in increased hidden damage. When the resistivity thus exceeds the range of 0.5 to 5.0MΩ·cm, the intended optical surface cannot be obtained in either case. Furthermore, in this range of resistivity, a proximity of 0.5MΩ·cm is most preferable. By setting the resistivity of the pure water to 0.5MΩ·cm, the chemical attack on the surface of the object to be washed can be reduced, so that the possible occurrence of hidden damage can be suppressed.

Furthermore, the pure water is preferred to be in a temperature range of 40° to 80° C., and in particular, a temperature of approximately 40° C. is most preferable. By setting the water temperature to approximately 40° C., the effect of easing the chemical attack becomes prominent. Furthermore, by setting the water temperature to approximately 40° C., an electric power for a hot pure water heater can be reduced to about one half in comparison with the case where the water temperature is 80° C.

Furthermore, by setting the 0.3 μm diameter particle count to a value not greater than 100 particles/ml, the possible occurrence of stains, blots and discoloration of the surface of the object to be washed is reduced as far as possible to achieve the washing.

g. Taking Out From Hot Pure Water

This is a process for taking the object to be washed from the pure water used in the above process. At the temperature maintained in the above process of "f. dipping into hot pure water", the object to be washed is taken out at a speed capable of uniformly draining off liquid.

h. Drying

This is a process for evaporating a moisture component left on the object to be washed taken out of the hot pure water and the jig that is holding the object to be washed. This process is comprised of a heating zone of the bath 13 (approximately 60° C.), a hot air zone of the bath 14 (approximately 80° C.), and a cooling zone of the bath 15 (approximately 60° C.). By providing the heating zone of the bath 13 (approximately 60° C.) as in the present embodiment, the possible abrupt temperature rise of the object to be washed can be prevented to prevent the glass material from being damaged.

As described in detail above, according to the present embodiment, the resistivity of the pure water to be used preferably falls consistently within the range of 0.5 to 5.0MΩ·cm. Therefore, in comparison with the case where a pure water having a resistivity of 10MΩ·cm or greater is used, the pure water producing cost can be remarkably reduced (by about one half).

Numeric Examples

Results obtained by implementing the washing method of the present invention will be described below.

Table 1 shows a relationship between the resistivity of pure water and hidden damage when washing is performed with a glass material having a refractive index of 1.75 and a dispersion of 35.13 with a taking-out temperature fixed to 40° C.

TABLE 1

Relationship Between the Resistivity of Pure Water and Hidden Damage

| Resistivity | 45 secs. | 90 secs. | 135 secs. |
|---|---|---|---|
| 10 MΩ · cm | Δ | Δ | X |
| 3 MΩ · cm | ○ | Δ | X |
| 0.5 MΩ · cm | ○ | ○ | ○ |

○ OK
Δ Limit
X No Good

As is evident from Table 1, when the resistivity of pure water is 10.0MΩ·cm, hidden damage limit is obtained only in washing times of 45 seconds and 90 seconds. When the resistivity of pure water is 3.0MΩ·cm, the hidden damage limit is obtained in a washing time of 90 seconds, and a surface having a satisfactory level of hidden damage is obtained in the washing time of 45 seconds. When the resistivity of pure water is 0.5MΩ·cm, a surface having a satisfactory level of hidden damage can be obtained in any of the washing times of 45 seconds, 90 seconds and 135 seconds. When the washing time exceeds 135 seconds, it takes too much time which is not practical.

Table 2 shows a relationship between the resistivity of pure water and the external appearance of the same glass material as shown in Table 1 when the material is subjected to washing under the condition of a taking-out temperature fixed to 40° C. in a like manner.

TABLE 2

Relationship Between the Resistivity of Pure Water and External Appearance of Some Glass Materials

| Resistivity | 30 secs. | 45 secs. | 90 secs. | 135 secs. |
|---|---|---|---|---|
| 10 MΩ · cm | Δ | Δ | Δ | X |
| 3 MΩ · cm | Δ | ○ | Δ | X |
| 0.5 MΩ · cm | Δ | ○ | ○ | ○ |
| 0.2 MΩ · cm | Δ | Δ | Δ | Δ |

○ OK
Δ Limit
X No Good

When the washing time is out of the range of Table 2, i.e., when the washing time is under 30 seconds, an external appearance limit occurs. Also, when the resistivity is 0.2MΩ·cm, the external appearance limit occurs. When the washing time exceeds 135 seconds, it takes too much time which is not practical.

Table 3 shows a relationship between the resistivity of pure water and hidden damage when washing is performed with a glass material having a refractive index of 1.49 and a dispersion of 83.5 with the taking-out temperature fixed to 40° C.

TABLE 3

Relationship Between the Resistivity of Pure Water and Hidden Damage

| Resistivity | 45 | 90 | 135 |
|---|---|---|---|
| 10 MΩ · cm | X | X | X |
| 3 MΩ · cm | Δ | X | X |
| 0.5 MΩ · cm | ○ | ○ | ○ |

TABLE 3-continued

Relationship Between the Resistivity of Pure Water and Hidden Damage

| Resistivity | 45 | 90 | 135 |
|---|---|---|---|

○ OK
Δ Limit
X No Good

As is evident from Table 3, when the resistivity of the pure water is 10.0MΩ·cm, the external appearance is defective. When the resistivity of pure water is 3.0MΩ·cm, the hidden damage limit occurs in the washing time of 45 seconds. When the resistivity of pure water is 0.5MΩ·cm, a surface having a satisfactory level of hidden damage can be obtained in any of the washing times of 45 seconds, 90 seconds and 135 seconds. When the washing time exceeds 135 seconds, it takes too much time which is not practical.

Table 4 shows a relationship between the resistivity of pure water and the external appearance of the same glass material as shown in Table 3 when the material is subjected to washing under the condition of a taking-out temperature fixed to 40° C. in a like manner.

TABLE 4

Relationship Between the Resistivity of Pure Water and External Appearance of Some Glass Materials

| Resistivity | 30 secs. | 45 secs. | 90 secs. | 135 secs. |
|---|---|---|---|---|
| 10 MΩ · cm | Δ | X | X | X |
| 3 MΩ · cm | Δ | Δ | X | X |
| 0.5 MΩ · cm | Δ | ○ | ○ | ○ |
| 0.2 MΩ · cm | Δ | Δ | Δ | Δ |

○ OK
Δ Limit
X No Good

When the washing time is out of the range of Table 4, i.e., when the washing time is under 30 seconds, an external appearance limit occurs. When the resistivity is 0.2MΩ·cm, the external appearance limit occurs. When the washing time exceeds 135 seconds, it takes too much time which is not practical.

Table 5 shows a relationship between the temperature of pure water and hidden damage when washing is performed with a glass material having a refractive index of 1.75 and a dispersion of 35.13 under the condition of a resistivity of 0.5MΩ·cm.

TABLE 5

Relationship Between the Temperature of Pure Water and Hidden Damage

| Temperature | 45 secs. | 90 secs. | 135 secs. |
|---|---|---|---|
| 40° C. | ○ | ○ | ○ |
| 50° C. | ○ | ○ | Δ |
| 60° C. | ○ | Δ | X |
| 70° C. | Δ | Δ | X |
| 80° C. | Δ | X | X |

○ OK
Δ Limit
X No Good

As is evident from Table 5, when the temperature of pure water is 80° C., the hidden damage limit is obtained only in the washing time of 45 seconds. When the temperature of pure water is 70° C., the hidden damage limit is obtained only in the washing times of 45 seconds and 90 seconds. When the temperature of pure water is 60° C., the hidden damage limit occurs in the washing time of 90 seconds, and a surface having a satisfactory hidden damage is obtained in the washing time of 45 seconds. When the temperature of pure water is 50° C., the hidden damage limit occurs in the washing time of 135 seconds, and a surface having a satisfactory level of hidden damage is obtained in the washing times of 45 seconds and 90 seconds. When the temperature of pure water is 40° C., a surface having a satisfactory hidden damage is obtained in any of the washing times of 45 seconds, 90 seconds and 135 seconds. When the washing time exceeds 135 seconds, it takes too much time which is not practical.

Table 6 shows a relationship between the temperature of pure water and hidden damage when washing is performed with a glass material having a refractive index of 1.75 and a dispersion of 35.13 under the condition of a resistivity of 0.5MΩ·cm.

TABLE 6

Relationship Between the Temperature of Pure Water and External Appearance of Some Glass Materials

| Temperature | 30 secs. | 45 secs. | 90 secs. | 135 secs. |
|---|---|---|---|---|
| 30° C. | Δ | Δ | Δ | Δ |
| 40° C. | Δ | ○ | ○ | ○ |
| 50° C. | Δ | ○ | ○ | Δ |
| 60° C. | Δ | ○ | Δ | X |
| 70° C. | Δ | Δ | Δ | X |
| 80° C. | Δ | Δ | X | X |

○ OK
Δ Limit
X No Good

When the washing time is out of the range of Table 6, i.e., when the washing time is under 30 seconds, an external appearance limit occurs. Also, when the temperature of pure water is 30° C., the external appearance limit occurs. When the washing time exceeds 135 seconds, it takes too much time which is not practical.

Table 7 shows a relationship between the temperature of pure water and hidden damage when washing is performed with a glass material having a refractive index of 1.49 and a dispersion of 83.5 under the condition of a resistivity of 0.5MΩ·cm.

TABLE 7

Relationship Between the Temperature of Pure Water and Hidden Damage

| Temperature | 45 secs. | 90 secs. | 135 secs. |
|---|---|---|---|
| 40° C. | ○ | Δ | Δ |
| 50° C. | ○ | Δ | X |
| 60° C. | ○ | Δ | X |
| 70° C. | Δ | X | X |
| 80° C. | X | X | X |

○ OK
Δ Limit
X No Good

As is evident from Table 7, when the temperature of pure water is 80° C., the external appearance is defective. When the temperature of pure water is 70° C., the hidden damage limit is obtained only in the washing time of 45 seconds. When the temperature of pure water is 60° C., the hidden damage limit is obtained in the washing time of 90 seconds, and a surface having a satisfactory level of hidden damage is obtained in the washing time of 45 seconds. When the temperature of pure water is 50° C., the hidden damage limit is obtained in the washing time of 90 seconds, and a surface having a satisfactory level of hidden damage is obtained in the washing time of 45 seconds. When the temperature of pure water is 40° C., the hidden damage limit is obtained in the washing times of 90 seconds and 135 seconds, and a surface having a satisfactory level of hidden damage is obtained in the washing time of 45 seconds. When the washing time exceeds 135 seconds, it takes too much time which is not practical.

Table 8 shows a relationship between the temperature of pure water and the external appearance when washing is performed with a glass material having a refractive index of 1.49 and a dispersion of 83.5 under the condition of a resistivity of 0.5MΩ·cm.

TABLE 8

Relationship Between the Temperature of Pure Water and External Appearance of Some Glass Materials

| Temperature | 30 secs. | 45 secs. | 90 secs. | 135 secs. |
|---|---|---|---|---|
| 30° C. | Δ | Δ | Δ | Δ |
| 40° C. | Δ | ○ | Δ | Δ |
| 50° C. | Δ | ○ | Δ | X |
| 60° C. | Δ | ○ | Δ | X |
| 70° C. | Δ | Δ | X | X |
| 80° C. | Δ | X | X | X |

○ OK
Δ Limit
X No Good

When the washing time is out of the range of Table 8, i.e., when the washing time is under 30 seconds, an external appearance limit occurs. Also, when the temperature of pure water is 30° C., the external appearance limit occurs. When the washing time exceeds 135 seconds, it takes too much time which is not practical.

As described in detail above, according to the method of the present invention, chemical damage (hidden damage) can be eased or eliminated as far as possible. A better external appearance can be obtained. At the same time, the pure water producing cost can be reduced (to about one half in comparison with the prior art). Furthermore, the electric power of the hot pure water heater can be reduced (to about one half in comparison with the prior art). Then, in the final dried state, washing is achieved without leaving stains, blots or discoloration on the surface of the object to be washed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A method for washing an object, comprising the steps of:

dipping the object to be washed in a heated liquid; and taking the object to be washed from the heated liquid used in said dipping process;

wherein the resistivity of the heated liquid is 0.5 to 5.0MΩ·cm.

2. The method as claimed in claim 1, wherein the heated liquid is heated pure water.

3. The method as claimed in claim 1, wherein the resistivity of the heated liquid is 0.5MΩ·cm to 3MΩ·cm.

4. The method as claimed in claim 1, wherein the resistivity of the heated liquid is 0.5MΩ·cm.

5. The method as claimed in claim 1, wherein the temperature of the heated liquid is 40° to 80° C.

6. The method as claimed in claim 1, wherein the temperature of the heated liquid is 40° C.

7. The method as claimed in claim 1, wherein the heated liquid has a 0.3 μm diameter particle count of not greater than 100 particles/ml.

8. The method as claimed in claim 1, wherein the object is an optical element.

9. The method as claimed in claim 1, wherein the object is one of a lens, a mirror, and a prism.

10. The method as claimed in claim 1, wherein the heated liquid is pure water having a resistivity of 0.5MΩ·cm, and the temperature of the pure water is 40° C., and the pure water has a 0.3 μm diameter particle count of not greater than 100 particles/ml.

11. A method for washing an object, comprising the steps of:

first, dipping the object to be washed in a lipophilic agent;

second, dipping the object to be washed in an emulsifier;

third, dipping the object to be washed in a detergent;

fourth, dipping the object to be washed in water;

fifth, dipping the object to be washed in liquid;

sixth, dipping the object to be washed in a heated liquid, said heated liquid having a resistivity of 0.5 to 5.0MΩ·cm;

seventh, taking the object to be washed from the heated liquid used in said sixth step; and eighth, holding the object to be washed in hot air.

12. The method as claimed in claim 11, wherein the resistivity of the heated liquid used in said sixth step is 0.5MΩ·cm.

13. The method as claimed in claim 11, wherein the temperature of the heated liquid used in said sixth step is 40° to 80° C.

14. The method as claimed in claim 11, wherein the temperature of the heated liquid used in said sixth step is temperature 40° C.

15. The method as claimed in claim 11, wherein the liquid used in said sixth step has a 0.3 μm diameter particle count of not greater than 100 particles/ml.

16. The method as claimed in claim 11, wherein the lipophilic agent used in said first process is perchloroethlene.

17. The method as claimed in claim 11, wherein lipophilic agent used in said first step is tetrachloroethylene.

18. The method as claimed in claim 11, wherein the resistivity of the liquid used in said fifth step is 0.5MΩ·cm, and the temperature of the liquid used in said fifth step is 20° to 30° C.

19. The method as claimed in claim 11, wherein said eighth step includes first holding the object to be washed in heating air whose temperature is the approximately 60° C., second, holding the object to be washed in heating air whose temperature is approximately 80° C., and third holding the object to be washed in heating air whose temperature is approximately 60° C.

20. A washing method for washing an object, comprising the steps of:

a degreasing process for removing greasy stains by dipping an object to be washed in a lipophilic agent;

a substituting water system process for preventing a greasy component of said degreasing process from entering a next process by dipping the object to be washed in an emulsifier;

a finish washing process for removing residues and hydrophilic stains in said degreasing process and said substituting water system process by dipping the object to be washed in a detergent;

a rinsing process for removing a residue of the finish washing process by dipping the object to be washed in liquid;

a finish rinsing process for removing particles and ions attached and left on the surface of the object to be washed by dipping the object to be washed in liquid;

a dipping process for dipping the object to be washed in a heated hot liquid, said dipping process using liquid having a resistivity of 0.5 to 5.0MΩ·cm;

a taking process for taking the object to be washed from the liquid used in said dipping process; and a drying process for evaporating a moisture component left on the object to be washed.

21. The method as claimed in claim 1 wherein chemical damage to the object is substantially suppressed when the object is dipped for a predetermined period of time.

22. The method as claimed in claim 11 wherein the resistivity of the heated liquid being between 0.5 and 5.0MΩ·cm reduces the likelihood of chemical damage to the object when the object is in the heated liquid for no more than a predetermined time limit.

23. The method as claimed in claim 20 wherein the object to be washed is dipped in the heated hot liquid for a predetermined time period, the resistivity of the hot liquid being 0.5 to 5.0MΩ·cm such that chemical damage to the object is substantially suppressed for the predetermined time period.

* * * * *